United States Patent [19]

Chegolya et al.

[11] 4,407,450

[45] Oct. 4, 1983

[54] METHOD OF AERODYNAMIC PRODUCTION OF LIQUID AND SOLID DISPERSE AEROSOLS

[76] Inventors: Alexandr S. Chegolya, poselok Khiminstituta, 10 kv. 7; Vladimir A. Malykh, ulitsa Gorkogo, 86/3, kv. 54; Vladimir V. Chizhov, poselok Khiminstituta, 17, kv. 7; Viktor I. Yankov, poselok Khiminstituta, 11, kv. 11; Nikolai I. Pirog, poselok Khiminstituta, 8, kv. 10, all of Kalinin, U.S.S.R.

[21] Appl. No.: 202,150

[22] Filed: Oct. 30, 1980

[51] Int. Cl.[3] ..... A62C 1/12

[52] U.S. Cl. ..... 239/8; 239/300; 239/422; 239/518; 239/543

[58] Field of Search ..... 239/8, 11, 290, 292, 239/296, 300, 419.3, 422, 427.3, 427.5, 428, 433, 518, 524, 543

[56] References Cited

U.S. PATENT DOCUMENTS

| | | | |
|---|---|---|---|
| 735,287 | 8/1903 | Neuendorff | 239/428 |
| 1,411,470 | 4/1922 | Bergman | 239/419.3 |
| 1,633,291 | 6/1927 | Sausen et al. | 239/300 |
| 1,876,669 | 9/1932 | Harlow | 239/524 |
| 2,247,548 | 7/1941 | Forster | 239/419.3 |
| 3,085,865 | 4/1963 | Long et al. | 239/419.3 |
| 3,790,080 | 2/1974 | Babington | 239/8 |

FOREIGN PATENT DOCUMENTS

| | | | |
|---|---|---|---|
| 809837 | 3/1937 | France | 239/290 |
| 154736 | 12/1920 | United Kingdom | 239/300 |
| 558604 | 1/1944 | United Kingdom | 239/296 |

*Primary Examiner*—John J. Love
*Assistant Examiner*—Michael J. Forman
*Attorney, Agent, or Firm*—Robert E. Burns; Emmanuel J. Lobato; Bruce L. Adams

[57] ABSTRACT

The method consists in that the liquid or solid particles being dispersed are brought in contact with a gas stream, which then conveys said particles till their collision with an obstacle, whereas said gas stream is subjected to symmetrical compression with gas streams whose discharge velocity 1.2 to 20 times that of the gas stream that conveys liquid or solid particles, and said symmetrical gas streams are so directed as to provide their homocentric convergence at an angle of from 30° to 90° on the obstacle.

The method enables production of liquid and solid aerosols with a degree of dispersity below 1 μm within a narrow range of particle sizes.

4 Claims, 1 Drawing Figure

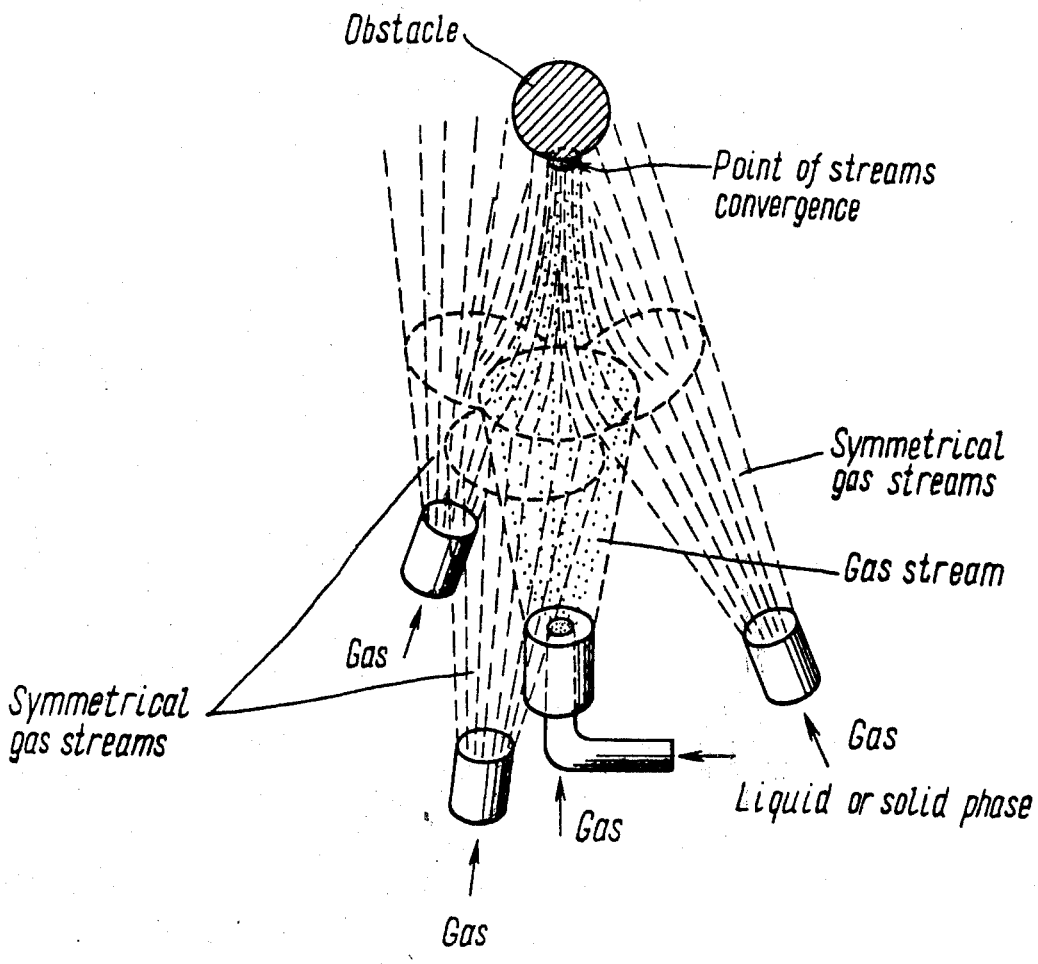
Obstacle
Point of streams convergence
Symmetrical gas streams
Gas stream
Gas
Symmetrical gas streams
Gas
Liquid or solid phase
Gas
Gas

METHOD OF AERODYNAMIC PRODUCTION OF LIQUID AND SOLID DISPERSE AEROSOLS

The present invention relates to methods of aerodynamic production of liquid and solid disperse aerosols.

FIELD OF THE INVENTION

The abovesaid liquid disperse aerosols find widespread application in diverse branches of national economy. Thus, for example, liquid disperse aerosols are made use of in medicine for treating various diseases by virtue of inhalation. Such aerosols are also applicable in veterinary sanitation for disinfecting production premises. Practical activity of liquid aerosols depends upon their dispersity and stability, which in turn depends upon the method of producing liquid disperse aerosols.

A number of industries, such as chemical, food, building-materials, and some others require application of finely and superfinely divided materials, e.g., mineral salts, fillers, dyes, pigments, ion-exchange resins. These finely and superfinely divided materials are isolated from solid disperse aerosols. The degree of dispersity of solid particles also depends on a method of producing solid disperse aerosols.

BACKGROUND OF THE INVENTION

A number of diverse methods of producing liquid and solid disperse aerosols are now in current use.

Thus, for instance, there is known a method of producing liquid disperse aerosols by virtue of ultrasound (cf. a textbook "Physical principles of ultrasonics" by O. K. Eknadiosiants, Moscow, Nauka Publishers, 1970 /in Russian/).

Carrying into effect this method involves feeding a stream (film) of liquid onto the oscillating element of a magnetostriction generator, i.e., supersonic-frequency oscillations are applied to the liquid. The effect of ultrasonic radiation results in that some individual drops of liquid get torn away from the crests of microwaves.

The method is instrumental in producing a narrow-disperse composition of the aerosol within a range of 1 to 4.8 μm. However, the method fails to find extensive application as it is applicable for dispersing low-viscosity liquids only. Besides, practical application of the method involves the use of special highly expensive ultrasonic generators (the cost of ultrasound dispersing of a liquid is 3 to 5 times that of pneumatic or mechanical methods of dispersing).

According to the aerodynamic method of producing liquid disperse aerosols dispersing of a liquid is due to a dynamic contacting of a flow of liquid with a flow of gas (cf. a textbook "Spraying of liquids by atomizers" by L. A. Vitman, Moscow 1962; and a textbook "Liquid atomizers" by D. G. Pazhi and V. S. Galustov, Moscow 1979 /both in Russian/). The method is carried into effect in such a way that the stream of gas discharges from the nozzle at a velocity as high as 150 to 300 m/s, whereas the discharge velocity of the liquid is comparatively low. Thus, the higher the difference between the discharge velocities of both streams the higher the degree of dispersity of the liquid. As a result there are produced liquid disperse aerosols featuring a very broad range of sizes of dispersed liquid particles (from 1.0 to 100 μm). However, the method involves a great deal of power to be consumed and fails to disperse high-viscosity liquids. Moreover, the method requires special liquid-handling pumps for liquid to feed.

One more prior-art method of producing liquid disperse aerosols by atomizing a liquid with a jet of gas in the presence of ferromagnetic solids is disclosed in USSR Inventor's Certificate No. 387,570. According to the method ferromagnetic solids are introduced into the liquid, whereupon the resultant mixture is passed through a zone of action of an alternating electromagnetic field, whereby the ferromagnetic solids, while travelling along the magnetic lines of force, break a continuous flow of liquid into a number of separate elements, which are then conveyed by a stream of the atomizing gas, subjected to secondary dispersing and are carried away.

However, dispersing a liquid by the above method is inevitably accompanied by partial entrainment of ferromagnetic solids together with the dispersed liquid. This imposes bad limitation upon the applicability of the method, as any presence of solid impurities is inadmissible in producing liquid disperse aerosols used in, say, medicine and veterinary sanitation. Low average degree of dispersity of the particles of the liquid being atomized, as well as a necessity of using complicated systems for establishing magnetic fields likewise restrict practical application of the method.

The most advanced of the heretofore known methods of producing solid disperse aerosols is the aerodynamic method, which is based on contacting a gas stream with the solid particles sucked into the outflowing portion of the gas stream, whereupon the solids are conveyed by the gas stream till colliding with an obstacle; while travelling the solids get pulverized by rubbing against one another and the walls of the apparatus (cf. "Air-stream mills" by V. I. Akunov, Moscow, 1967; "Disintegration processes in chemical industry" by P. M. Sidorenko, Moscow 1977 /both in Russian/). This method is carried into effect in air-stream mills featuring a flat, vertical, or counterflow grinding chamber.

The aerodynamic method of producing solid disperse aerosols is characterized by the following features:

1. Low impact impulse of the solids at the instance of their collision with the obstacle, which is accounted for by the fact that the solids are accelerated in an expanding gas stream, whereby the velocity of the solids drops and but low kinetic energy is imparted thereto. Thus, successful realization of the method depends upon the hardness of the initial stock being pulverized.
2. High degree of attrition of penumoaccelerators used in counterflow aerodynamic atomization, as the solid disperse aerosol moves at a high speed with respect to the walls of the apparatus and proves to a highly efficient attrition abrasive.
3. Realization of this method gives aerosols within a broad range of dispersity (particle size), in a majority of cases falling within 2 and 10 μm, while occasionally the upper limit of dispersity reaches 30 μm and the lower one, 1 μm. This is owing to low impact energy at the instance of collision of the solids with the obstacle and to low probability for these solids to impinge upon one another.

BRIEF DESCRIPTION OF THE INVENTION

It is a primary object of the present invention to provide such a method of aerodynamic production liquid and solid disperse aerosols that would enable production of these aerosols featuring a narrow disperse composition and particle size below 1 μm involving minimized power expenses, and would be capable of controlling the degree of dispersity of the aerosol obtained.

According to said and other objects the present invention resides in that in the herein-disclosed method of aerodynamic production of liquid and solid disperse aerosols by bringing the liquid or solid particles being dispersed in contact with a gas stream, followed by conveying said particles by the gas stream till their colliding with an obstacle. According to the present invention, said gas stream conveying liquid or solid particles is subjected to symmetrical compression with gas streams whose discharge velocity is 1.2 to 20 times that of the gas stream conveying liquid or solid particles in such a manner that the symmetrical gas streams should be so directed as to provide their homocentric convergence at an angle of from 30° to 90° on the obstacle.

As it has been pointed out hereinbefore the method of the present invention resides in that the main gas stream carrying the liquid being dispersed or the solid phase being pulverized, is subjected to symmetrical compression with gas streams whose axial components converge homocentrically at a single point, where a solid lined obstacle is situated, such as a steel ball, cylinder or a heavy disk. As a result, the kinetic energy of the main gas stream, containing liquid or solid particles, gets transformed which is followed by impact effect produced upon the solid or liquid particles being dispersed by the solid obstacle.

The main gas stream discharged at a velocity of from 10 to 100 m/s to atomize the liquid particles or accelerate the solid particles, which are then fed to the zone of discharge of the gas stream.

Further on the gas stream conveying the solid or liquid particles is subjected to symmetrical compression with gas streams whose discharge velocity ranges within 100 and 320 m/s, while the axial components of these streams converge at the same point, the angle of convergence of the symmetrical gas streams lying within 30° and 90°. This is accompanied by a phenomenon similar to passing a gas flow through a convergent confuser established by the symmetrical gas streams, whose discharge velocity is 1.2 to 20 times that of the main gas stream. Reduction in the cross-sectional area of the carrying gas stream and hence increase in the velocity thereof occur without much energy losses due to friction. As the cross-sectional area of the carrying gas stream diminishes an abrupt rise of its kinetic energy occurs, which conduces to an increased travelling speed or acceleration of the liquid or solid particles. Next the kinetic energy of the dispersed liquid or accelerated solids is transformed into impact energy due to the fact that a solid obstacle is placed at the point of convergence of the axial components of the symmetrical gas streams. Thus, the particles of liquid or solid phase are subjected to or impact effect to be finally disintegrated so as to produce a liquid or solid disperse aerosol.

The degree of disintegration (dispersion) can be controlled by varying the velocity of the symmetrical gas streams so as to reduce or increase particle size of a resultant aerosol.

The herein-disclosed method of aerodynamic production of liquid and solid disperse aerosols is advantageous over the heretofore-known methods in being capable of producing a solid or liquid aerosol of a disperse composition within a desired range.

According to this method there are practically attainable dispersing a liquid and pulverizing a solid with a degree of dispersity below 1 μm with a narrow dispersity range. Moreover, the method of the present invention involves power consumption 1.5 to 2 times as low as in the known methods.

BRIEF DESCRIPTION OF THE DRAWING

The present invention will be hereinafter described with reference to the accompanying drawing illustrating diagrammatically an apparatus and method according to the present invention.

DETAILED DESCRIPTION OF THE INVENTION

The method in question is simple as to process techniques involved and is carried into effect as follows.

Gas is fed through an atomizer nozzle, wherein the main gas stream is established. Then the material to be dispersed (a liquid or solid particles) is fed to the zone of discharge of the gas from the nozzle as shown in the drawing. As a result, the liquid or the solid particles are preliminarily dispersed in the main gas stream outflowing portion and are then entrained by the main gas stream to be conveyed against an obstacle as shown. The gas stream conveying the liquid or the solid particles is symmetrically compressed by other gas streams, which are discharged from other nozzles that are so arranged with respect to the centrally disposed main gas stream nozzle as to provide homocentric convergence of the gas streams at an angle of from 30° to 90° on the obstacle. The thus-accelerated liquid or solid particles collide with the obstacle, whereby their final dispersing to a preset degree of dispersity occurs. The degree of dispersity is controlled by changing the ratio of the velocity of the symmetrical compressing gas streams to that of the main gas stream.

To promote understanding below are given the following specific examples of practical embodiments of the present invention.

EXAMPLE 1

Air at a temperature of 20° C. is fed to an air-stream atomizer having a dia. 3 mm exit nozzle, the discharge velocity of the air from the nozzle being 90 m/s. Simultaneously water is fed to the atomizer nozzle at a mass rate of flow of 5 kg/h.

The gas stream conveying the liquid being dispersed is compressed by four symmetrical air streams whose discharge velocity equals 110 m/s. The nozzles from which the compressing gas streams discharge are so arranged that the gas streams should homocentrically converge at the same point, the angle of convergence of the axial components of these compressing gas streams is equal to 30°. A dia. 18 mm hardened-steel ball constitutes the obstacle and is placed at the point of convergence of the gas streams.

The resultant liquid aerosol features the disperse composition of 5 to 20 μm. For the sake of comparison a similar aerosol of water and air is produced as follows. Air is fed to a dia.3 mm exit nozzle of the atomizer at a temperature of 20°, and is discharged therefrom at a velocity of 90 m/s. Simultaneously water is fed to the atomizer nozzle at a mass rate of flow equal to 5 kg/h. The thus-obtained aerosol features the disperse composition of 30 to 100 μm.

EXAMPLE 2

Air at a temperature of 20° C. is fed to an air-stream atomizer having a dia.2 mm exit nozzle, the discharge velocity of the air from the nozzle being 15 m/s. A 10-percent glycerol solution is fed simultaneously to the atomizer nozzle at a mass rate of flow equal to 2 kg/h. The gas stream conveying the liquid being dispersed is compressed by six symmetrically arranged air streams whose discharge velocity equals 300 m/s. The nozzles wherefrom the compressing gas streams discharge are so arranged that the gas streams should homocentrically converge at the same point, the angle of convergence of the axial components of these compressing gas streams is equal to 58°. A dia.10 mm steel ball is placed at the point of convergence of the gas streams. The resultant liquid aerosol features the disperse composition of 0.5 to 1 μm.

EXAMPLE 3

Nitrogen at a temperature of 15° C. is fed to an air-stream atomizer having a dia.0.5 mm exit nozzle, the discharge velocity of the nitrogen from the nozzle being 50 m/s. An acid of the formula as such $CH_3(CH_2)_2COOH$ is fed simultaneously to the atomizer nozzle at a mass rate of flow equal to 0.8 kg/h. The gas stream conveying the liquid being dispersed is compressed by three symmetrically arranged streams of nitrogen whose discharge velocity equals 300 m/s. The nozzles wherefrom the compressing gas streams are discharged are so arranged that these gas streams should homocentrically converge at the same point, the angle of convergence of the axial components of the compressing gas streams being equal to 40°. A dia.6 mm steel ball is placed at the point of convergence of the gas streams. The resultant liquid aerosol features the disperse composition of 3 to 8 μm.

EXAMPLE 4

Air at a temperature of 20° C. is fed to a dia.4 mm atomizer nozzle, the discharge velocity of the air from the nozzle being 100 m/s. Fed to the zone of air discharge from the atomizer nozzle is titanium dioxide featuring an average size of particles and agglomerates up to 100 μm. The gas stream conveying the solid particles is compressed by four symmetrically arranged air streams whose discharge velocity equals 320 m/s. The nozzles wherefrom four air streams are discharged are so arranged that the air streams should homocentrically converge at the same point, the angle of convergence of the axial components of these air streams is equal to 30°. A dia.20 mm titanium ball is placed at the point of convergence of the air streams. The resultant aerosol features the disperse composition of 0.5 to 1 μm.

EXAMPLE 5

Air at a temperature of 25° C. is fed to a dia.5 mm atomizer nozzle, the discharge velocity of the air from this nozzle is 150 m/s. An ion-exchange resin is fed to the zone of air discharge from the atomizer nozzle at a mass rate of flow equal to 5 kg/h, an average particle size of the resin being 1000 μm. The gas stream conveying the solid particles is compressed by eight symmetrically arranged air streams whose discharge velocity equals 300 m/s. The nozzles wherefrom the eight air streams are discharged are so arranged that these air streams should homocentrically converge at the same point, the angle of convergence of the axial components of the air streams is equal to 90°. A dia.30 mm steel ball is placed at the point of convergence of the air streams.

The resultant aerosol features the disperse composition of 1 to 5 μm. For the sake of comparison there is disintegrated an ion-exchange resin featuring an average particle size of 1000 μm, using an air-stream mill with a flat grinding chamber. The volume rate of flow of air at a temperature of 20° C. equals 300 $m^3/h$, the air pressure being 0.7 $MN/m^2$ (7 atm.gauge). The resultant solid disperse aerosol is taken off continuously at a rate of 10 kg/h.

The thus-obtained aerosol features the disperse composition of 5 to 20 μm.

What is claimed is:

1. A method of aerodynamically producing an aerosol of solid or liquid particles, comprising developing a main gas stream with entrained atomized liquid or solid particles, compressing the main gas stream radially and constricting it during axial travel thereof by application thereto of at least three converging gaseous streams symmetrically disposed circumferentially of said main gas stream and converging to a given point of convergence, impacting the compressed main gas stream with the entrained particles therein on a solid obstacle having curvature at the point of convergence of the gaseous streams, and the point of convergence being disposed on a curved surface of said obstacle on which the main gaseous stream and said particles are impacted, and the three gaseous streams constricting the main gas stream upstream of said obstacle to maintain it in a constricted state during axial travel thereof until it strikes said obstacle, whereby an aerosol dispersion of the particles is developed at said obstacle.

2. A method of aerodynamically producing an aerosol of solid or liquid particles according to claim 1, in which the gas streams disposed symmetrically about the main gas stream have a velocity which is 1.2 to 20 times the velocity of the main gas stream and said gas streams are disposed to effect homocentric convergence at an angle on the obstacle and said angle of convergence ranging from 30° to 90°.

3. Apparatus for aerodynamically producing an aerosol of solid or liquid particles comprising, atomizer means for developing a gaseous main stream having particles of a solid or liquid particles comprising, atomizer means for developing a gaseous main stream having particles of a solid or liquid dispersed therein, other nozzle means for applying at least three converging gaseous streams symmetrically about the main gaseous stream to effectively compress the gaseous main stream radially constricting it during axial travel thereof and converging at a point of convergence downstream of said nozzle means, and solid means having a curved surface at said point of convergence on which the radial compressed gaseous main stream and the converging gaseous streams impact, and said other nozzle means being disposed for applying said gaseous streams to said main stream upstream of said solid means constricting it along its path of travel axially until it impacts said curved surface, whereby the streams develop an aerosol of the particles upon said impact.

4. Apparatus for aerodynamically producing an aerosol of solid or liquid particles according to claim 3, in which said solid means is a sphere.

* * * * *